US005146773A

United States Patent [19]

Rosier

[11] Patent Number: 5,146,773

[45] Date of Patent: Sep. 15, 1992

[54] TAPERED ROTATABLE OFFSET NOSE ASSEMBLY

[75] Inventor: Hendrik E. Rosier, Kingston, N.Y.

[73] Assignee: Huck Manufacturing Co., Irvine, Calif.

[21] Appl. No.: 732,864

[22] Filed: Jul. 19, 1991

[51] Int. Cl.[5] ..... B21J 15/30

[52] U.S. Cl. ..... 72/391.4; 29/243.522; 29/243.529

[58] Field of Search ..... 72/391.2, 391.4, 391.8; 29/243.521, 243.522, 243.523, 243.524, 243.525, 243.528, 243.529

[56] References Cited

U.S. PATENT DOCUMENTS

| | | | |
|---|---|---|---|
| 3,528,277 | 9/1970 | Perkins | 72/453.17 |
| 3,605,478 | 9/1971 | Chirco | 29/243.529 |
| 3,665,581 | 5/1972 | Gulistan | 29/243.529 |
| 4,598,572 | 7/1986 | Mondello et al. | 29/243.522 |
| 4,615,206 | 10/1986 | Rosier | 29/243.523 |
| 4,796,455 | 1/1989 | Rosier | 72/391.2 |
| 4,813,261 | 3/1989 | Rosier | 72/453.17 |
| 4,896,522 | 1/1990 | Rosier | 29/243.521 |
| 4,989,442 | 2/1991 | Rosier | 72/453.17 |

*Primary Examiner*—David Jones
*Attorney, Agent, or Firm*—Harness, Dickey & Pierce

[57] ABSTRACT

A rotatable nose assembly for swaging a fastener collar onto a grooved fastener pin in an application where there is only limited access to the pin and collar assembly. A swaging anvil has parallel flat side faces adapted to fit into a channel-shaped workpiece to facilitate swaging motion of the anvil along the collar surface. The anvil has a rotary swivel connection to the nose assembly such that the flat side faces of the anvil can be rotated to fit different orientations of the channel flanges.

6 Claims, 2 Drawing Sheets

TAPERED ROTATABLE OFFSET NOSE ASSEMBLY

BACKGROUND OF THE INVENTION

1. Field of the Invention

This invention relates to an apparatus for swaging a fastener collar onto a fastener pin extending through a pair of facially-engaged workpieces.

2. Description of Prior Developments

Fasteners of the pin and collar type are often used in aircraft construction, e.g. frames and panels used to form aircraft wings and aircraft cabins. In each case a headed fastener pin extends through aligned circular holes in the workpieces being secured together. A fastener collar is fitted loosely on a projecting portion of the pin, after which a fluid-actuated tool is operated to swage the collar radially into circumferential grooves in the pin side surface. The collar is thus firmly secured to the pin. This achieves a high strength fastening action on the associated workpieces which are sandwiched between the collar and the head of the pin.

In some instances the workpieces have overhanging wall sections or flanges that limit access of the nose assembly of a fastener tool to the pin and collar assembly. One particular instance of such a limited access situation is an upright frame structure used to mount or frame windows in aircraft cabins. The upright window frame structure includes a relatively small, substantially annular frame element nested within a larger frame element. These frame elements are held together by a series of spaced apart pin and collar fasteners.

The larger frame element has a channel-shaped cross section oriented so that the bottom web of the channel forms the outer edge surface of the frame, and the side flanges of the channel extend radially inwardly from the web to define the two flat upright major faces of the frame. The smaller frame element has a channel-shaped cross section sized to fit into the larger channel. The two channel members are secured together by several swaged pin and collar fasteners extending through the mating channel walls at spaced points. The channel flanges have different orientations at different points around the frame structure, e.g. horizontal orientations at the upper and lower edges of the right structure, and vertical orientations along the side edges of the ring structure.

In this application the swaging nose assembly of the installation tool for the fasteners has to fit into the limited space between the flanges of the smaller channel in order to effectively grip the pin and swage the fastener collar. Because of the limited space, prior nose assemblies have been difficult to position and manipulate within such confined and obstructed application areas. U.S. Pat. No. 4,598,572 and U.S. Pat. No. 4,796,455 show apparatus for a generally similar purpose.

SUMMARY OF THE INVENTION

The present invention concerns a tool construction having a tapered or chisel-shaped nose assembly designed to fit into a relatively narrow channel. The nose assembly is configured to be easily inserted and positioned within the interior space of the channel without striking the channel walls. Flat side faces of the nose assembly are in close radial registry with the channel flanges during the collar swaging motion. The nose assembly is rotatably adjustable around its pin pulling axis so that its flat side faces can have a range of different orientations related to different orientations of the channel flanges.

Rotational adjustability of the nose assembly around its pin-puller axis enables its flat chisel-shaped side faces to closely conform to the channel flanges while still enabling the tool operator to hold the installation tool in a relatively comfortable position, without requiring twisting of the arms or torso from a normal position facing the frame structure.

In a preferred form of the invention, the installation tool is a hand-held device having a trigger and a fluid-actuated piston and cylinder arrangement. The nose assembly is connected to the fluid cylinder through a radial offset collet structure, such that the pin puller axis is offset radially from the fluid cylinder axis. A swivel mechanism is incorporated into the joint between the radially offset nose assembly and the fluid cylinder so that the tool operator can hold the tool in a comfortable position while permitting the nose assembly to be selectively swung or rotated to different adjusted positions within different portions of the annular frame structure.

The installation tool is designed to access partially obstructed clearance spaces within and around an annular ring-like frame structure, such that fastener pin and collar assemblies in different areas of the frame structure can be fastened to the frame structure in a minimum time period and without undue physical stress on the tool operator.

THE DRAWINGS

DETAILED DESCRIPTION OF THE PREFERRED EMBODIMENTS

Figure 1:
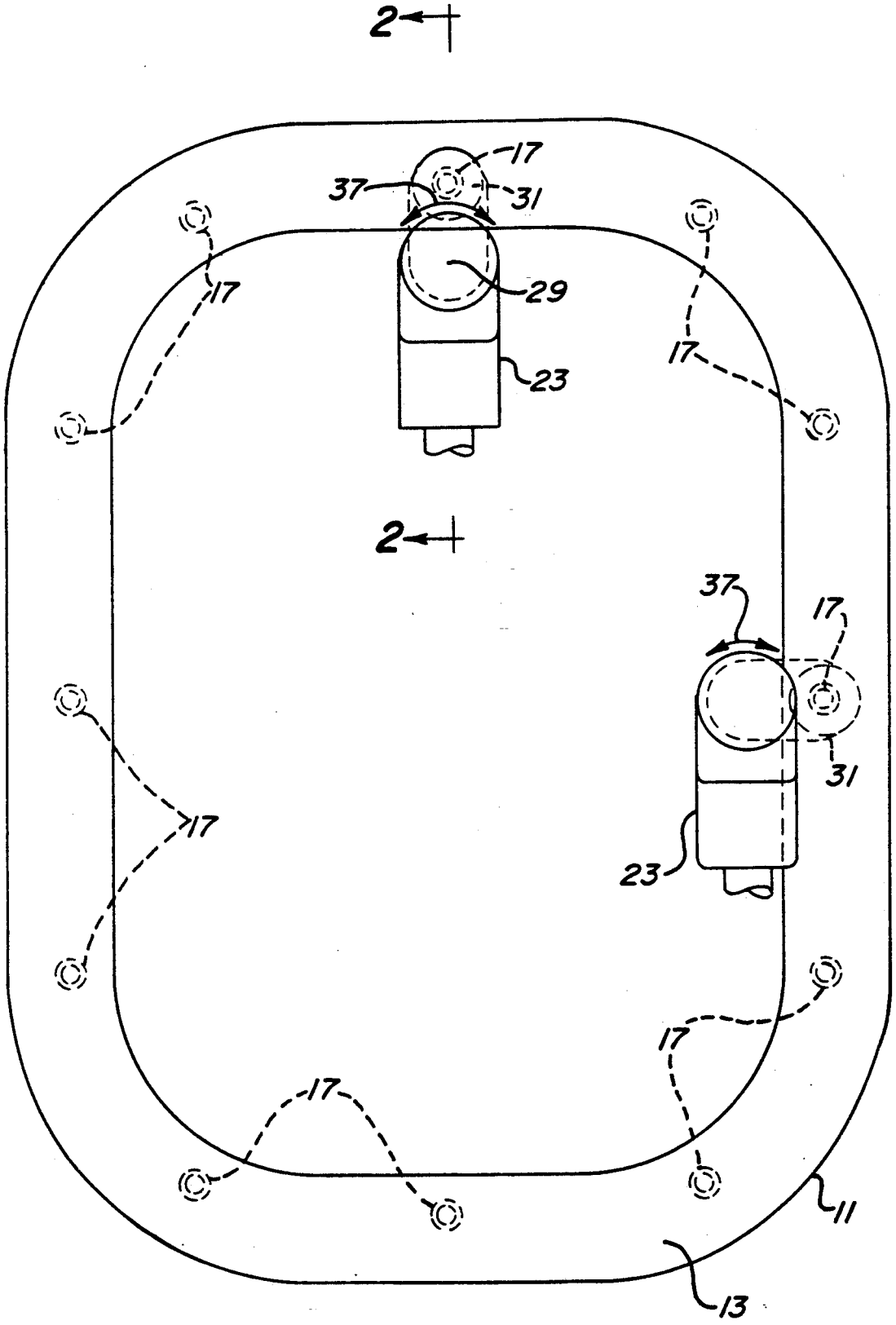
FIG. 1 is a front view of an annular frame structure showing a fastener installation tool in position for swaging a fastener collar onto a fastener pin extending through mated wall areas of the frame structure.
Figure 2:
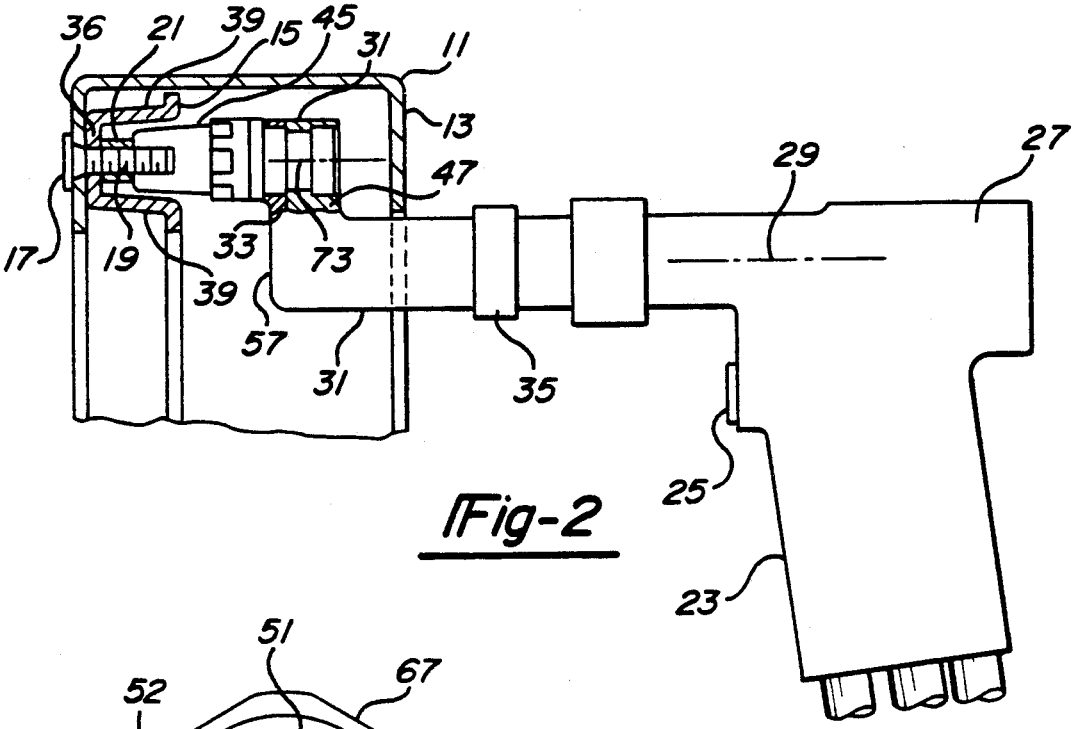
FIG. 2 is a fragmentary sectional view taken along line 2—2 in FIG. 1.

The invention will now be described in conjunction with the drawings, beginning with FIGS. 1 and 2 which show an annular frame structure 11 of the type used to frame a window within the cabin wall of an aircraft. The frame structure includes an outer annular frame element 13 and an inner annular frame element 15. Each frame element has a U-shaped or channel-shaped cross section, as shown in FIG. 2. The two frame elements are secured together by a number of pin and collar fastener assemblies 17 spaced around the frame structure. Each fastener assembly includes a pin 19 and an annular collar 21 swaged into axially-spaced circumferential grooves formed in the side surface of the pin.

FIG. 2 shows the fastener assembly prior to the collar swaging operation which is carried out by a fluid-powered tool 23. Hand-held actuator tool 23 includes a trigger 25 for controlling the operation of a fluid cylinder 27 and a piston which is slidable within the fluid cylinder along actuator axis 29 to operate a collar-swaging nose assembly 31.

Nose assembly 31 may be constructed, for example, as shown in U.S. Pat. No. 4,796,455. The nose assembly may be fitted with a swivel connection 35 such as shown in U.S. Pat. No. 4,896,522 so that the entire nose assembly may be rotated circumferentially in any radial direction from piston axis 29, as indicated by arrow 37 in FIG. 1. Tool 23 can be held in an upright attitude, with piston axis 29 orientated horizontally normal to the plane of frame structure 11. Nose assembly 31 may be rotated to extend radially upwardly from tool 23, or laterally from tool 23, or radially downwardly from the tool, as may be necessary to enable to nose assembly to conveniently access different interior areas of annular frame structure 11 without changing the upright attitude of tool 23.

As seen in FIG. 2, inner frame element 15 has a channel-shaped cross section defined by a web 36 and two flanges 39. Fastener pin 19 extends through aligned circular holes in frame elements 13 and 15 so that the grooved shank portion of the pin is located within the space circumscribed by flanges 39. This arrangement of the fastener pin between the flanges has the effect of somewhat restricting access to collar 21 by nose assembly 31.

Figure 3:
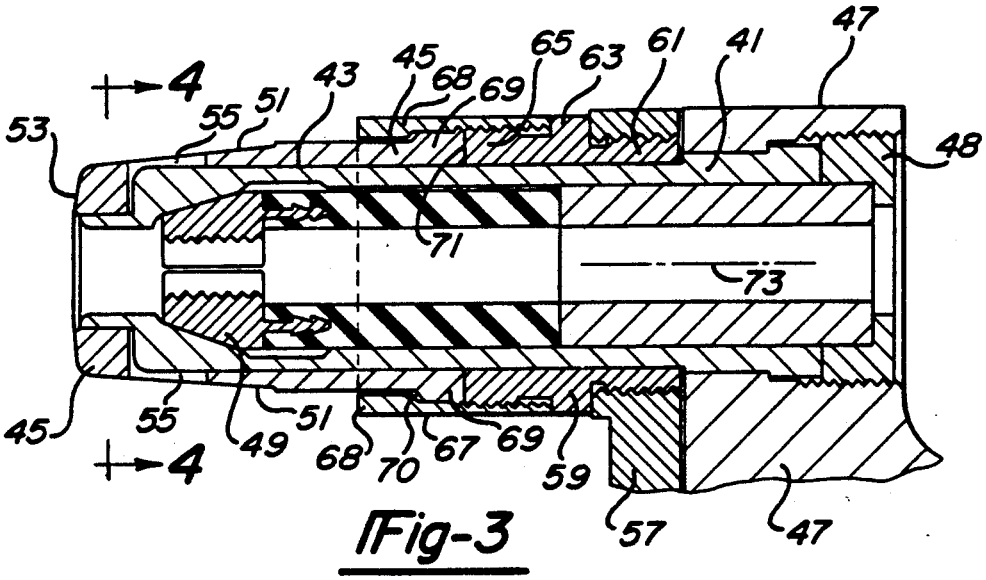
FIG. 3 is an enlarged fragmentary sectional view taken through a pin puller nose assembly used in the FIG. 2 fastener tool.

The nose assembly includes a tubular collet cartridge 41 (FIG. 3) that has a cylindrical outer side surface 43 telescoped within an annular anvil 45. Collet cartridge 41 has its right end portion extending through a collet body 47 that extends radially across axes 29 and 73. Collet body 47 is mounted for reciprocating motion within nose assembly 31.

A nut 48 is screwed into a threaded counterbore in collet body 47 to rigidly attach the collet cartridge 41 to the collet body. The collet cartridge includes a multipiece segmented jaw assembly 49 that may be constructed as shown in U.S. Pat. No. 4,598,572.

Figure 4:
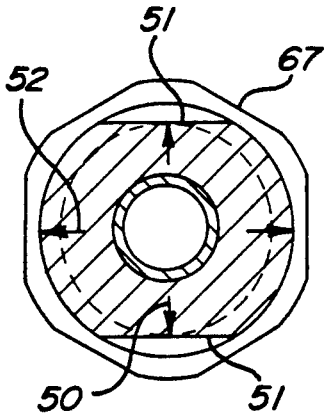
FIG. 4 is a transverse sectional view taken along line 4—4 in FIG. 3.

Anvil 45 includes an annular cylindrical portion having two opposed tapering flats or cutout side faces 51 configured in the manner of a chisel. These flat side faces diverge slightly in a left-to-right direction, from end face 53 of the anvil to a point about half-way along the axial length of the anvil. The angular divergency of side faces 51 from each other may be about ten degrees or about five degrees measured from the mandrel axis. The transverse width 50 of the anvil measured between side faces 51 normal to axis 73 is substantially less than the transverse diameter 52 measured parallel to side faces 51 as seen in FIG. 4.

Anvil 45 is connected to a radial wall 57 of nose assembly 31 via a tubular adaptor 59. In a functional sense, wall 57 is operatively connected to the cylinder portion of the tool 23, whereas collet body 47 is operatively connected to the piston portion of the tool. Rightward motion of the piston within cylinder 27 causes collet body 47 to move rightwardly relative to radial wall 57, such that anvil 45 exerts a leftward swaging force on collar 21 (FIG. 2).

Tubular adaptor 59 has a first threaded section 61 screwed into a threaded opening in wall 57. Adaptor 59 also includes a central annular rib 63 abutable against the outer face of wall 57, and a second threaded section 65 adapted to mesh with an internally threaded retainer nut 67. Central rib 63 limits the axial motion of nut 67 and helps to axially position the anvil 45 along the adaptor.

An inturned flange 68 on the left end of nut 67 is dimensioned to provide a small axial clearance 70 with respect to an out-turned flange 69 on the right end of anvil 45. This axial clearance allows for substantially free rotation of anvil 45 around collet cartridge 41. Clearance 70 prevents frictional axial clamping engagement of anvil 45 with end face 71 of the adaptor and further prevents such clamping between flanges 68 and 69.

FIG. 2 illustrates the swaging apparatus prior to a collar-swaging operation. Anvil 45 is orientated so that its flat side faces 51 are in radial registry with, and aligned substantially parallel to, channel flanges 39. During the swaging operation, the collet cartridge 41 exerts a rightward pulling force on pin 19 and anvil 45 exerts a leftward swaging force on collar 21. The power for the swaging operation is supplied by fluid cylinder 27. Anvil 45 shifts leftwardly along the outer surface of collar 21 to effect the swaging operation.

The flat, tapering inset side faces 51 on anvil 45 constitute an important feature of the invention. Tapered side faces 51 effectively reduce the mandrel diameter without appreciably changing the mandrel strength and rigidity. The mandrel can therefore move into the narrow space circumscribed by the channel flanges 39 to effect the swaging operation even though the flange 39 spacing might be somewhat less than the mandrel nominal diameter 52. The divergence of side faces 51 is designed to facilitate initial entry of the anvil into the channel space.

The anvil does not have to have precise parallelism between faces 51 and the channel flanges in order to fit the anvil into the channel. Also, the divergence of side faces 51 serves to reduce the weakening effect of mandrel strength caused by the loss of material section along faces 51. Transverse holes 55 are formed through flat side faces 51 in order to reduce or preclude stress cracking that might occur in the extremely thin wall sections produced by the flat side faces. These holes, which expose an end portion of collet cartridge 41, also serve as an escape channel for sealant which is applied between the frame elements 13 and 15.

Anvil rotation is for the purpose of orienting flat side faces 51 into registry with channel flanges 39 as the tool is moved to different locations around frame structure 11. At the upper and lower edges of the frame structure, the channel flanges 39 are essentially horizontal, whereas along the sides of the frame structure, the channel flanges are essentially vertical. Rotational adjustment of anvil 45 around anvil axis 73 enables the flat side faces 51 of the mandrel to fit into the channel 15 at any location along frame structure 11.

The apparatus is intended to be used with the hand-operated tool in an upright position wherein the operator grips trigger 25 without having to twist the arm or body into an unnatural or uncomfortable position. The swivel connection 35 enables the nose assembly 31 to be swung around axis 29 for entry into partially obstructed clearance spaces formed by channel 13. The tool actuator portion 23 does not have to be titled or overturned in order to gain access to the partially obstructed clearance spaces. FIG. 1 shows two illustrative positions of the apparatus.

Primary features of the invention are the tapering flat inset side faces 51 on the mandrel, and the rotational adjustment of the anvil provided by adaptor 59 and nut 67. The force-transmitting connection from the adaptor to the anvil is maintained in all rotated positions of the anvil. The collar-swaging operation does not impose any added axial force on threads 65. Swaging force is transmitted through end face 71.

Obviously, numerous modifications and variations of the present invention are possible in the light of the above teachings. It is therefore to be understood that within the scope of the appended claims, the invention may be practiced otherwise than as specifically described herein.

What is claimed is:

1. An offset nose assembly for use with a fastener installation tool powered by a piston movable within a cylinder along an actuator axis, said assembly comprising:

anvil means having a tapered end portion which includes a pair of substantially flat opposed side surfaces which extend along and define a reduced material section diverging forwardly along said end portion of said anvil means each of said side surfaces having a hole formed therein;

collet means slidable within said anvil means and having a portion exposed by each said hole;

jaw means carried by said collect means and movable along an axis radially spaced from said actuator axis; and mounting means for rotatably mounting said anvil means on said nose assembly for selective orientation of said end portion around said offset axis.

2. The assembly of claim 1, wherein said collet means comprises a collet cartridge secured within a collet body.

3. The assembly of claim 1, wherein each of said pair of substantially flat side surfaces is formed with a hole which exposes a portion of said collet means.

4. The assembly of claim 1, wherein said mounting means comprises a tubular adaptor for connecting said anvil means to a radial wall portion of said nose assembly.

5. The assembly of claim 4, wherein said mounting means further comprises a retainer nut for connecting said anvil means to said tubular adaptor.

6. The assembly of claim 5, wherein said retainer nut comprises an in-turned flange, wherein said anvil means comprises an out-turned flange and wherein an axial clearance is provided between said flanges for allowing substantially free rotation of said anvil means around said collet means.

* * * * *